United States Patent [19]

Krywiczanin et al.

[11] Patent Number: 4,553,712

[45] Date of Patent: Nov. 19, 1985

[54] FEEDING WEB MATERIAL

[75] Inventors: Wladyslaw H. Krywiczanin, Fairoak; William Lumsden, Winchester, both of England

[73] Assignee: British-American Tobacco Company Limited, London, England

[21] Appl. No.: 328,672

[22] Filed: Dec. 8, 1981

[30] Foreign Application Priority Data

Dec. 22, 1980 [GB] United Kingdom ..... 8041062

[51] Int. Cl.[4] ..... B65H 19/18; B65H 21/00; B31F 5/06

[52] U.S. Cl. ..... 242/58; 226/97

[58] Field of Search ..... 242/55, 57, 58, 58.1, 242/58.2, 58.3, 58.4, 58.5, 58.6, 78, 78.8, 81; 226/97, 95; 131/60; 156/497, 502, 504, 505

[56] References Cited

U.S. PATENT DOCUMENTS

| | | | |
|---|---|---|---|
| 2,736,106 | 2/1956 | Offen | 226/97 |
| 3,743,197 | 7/1973 | Hawkins | 226/97 |
| 3,873,393 | 3/1975 | Bruck et al. | 156/497 |

FOREIGN PATENT DOCUMENTS

| | | | |
|---|---|---|---|
| 2411238 | 3/1973 | Fed. Rep. of Germany | 226/97 |

*Primary Examiner*—Stuart S. Levy
*Assistant Examiner*—Lloyd D. Doigan
*Attorney, Agent, or Firm*—Kane, Dalsimer, Kane, Sullivan and Kurucz

[57] ABSTRACT

Apparatus for supplying web material from reels thereof to a web-utilizing machine comprises a reel changer including a reel store, means for advancing reels in the store in succession to a reel-unwinding location, a web-transport system for feeding and guiding to the machine a web extending from a reel at that location, which system comprises at least one air mover, means for sensing the absence of web from a portion of the extent of the system and control means responsive to signals from said sensing means to activate air-supply to the air movers, whereby a leading end of a web length extending from a said reel is fed to the outlet end of the system. The web path of the transport system may include at least one curved portion defined by an air bearing. When the web is running through the transport system, air is supplied to the air bearing or bearings but not to the air mover or movers and, when a web end is being advanced to the utilizing machine, air is supplied to the air mover or movers, but not to the air bearing or bearings. A storage and advancing unit in the reel changer may comprise a hollow mandrel, means for advancing reels along the mandrel to the unreeling location and means operable at that location for coupling the reel to a rotatable shaft. There may be two reel changers associated with respective air movers which can be selectively brought into operative relation with an onward-going further air mover.

7 Claims, 6 Drawing Figures

FEEDING WEB MATERIAL

BACKGROUND OF THE INVENTION

1. Field of the Invention

This invention relates to the feeding of web material to, for example, web-utilising machinery.

2. Brief Description of the Prior Art

Machines of numerous types have a requirement for the supply of materials in continuous web form. For example cigarette-making machines, cigarette filter-making machines and cigarette-packing machines require to be fed with continuous webs of material such as cigarette paper, filter-plugwrap paper, metallic foil and plastics film material. It is usual in the case of such tobacco-industry machinery for reels of the materials to be mounted on the respective machines.

In the current search for higher rates of machine productivity, various expedients have been proposed for reducing the necessity for, or frequency of, intervention by the machine operator. One reason for operator intervention is the replenishment of expiring reels of web materials. It has heretofore been necessary in the case of tobacco-industry machines for a machine operator to carry out manual procedures in connection with each replacement of an expiring reel by a fresh reel and the splicing operation between the old and new webs. Similar manual procedures have had to be carried out upon the occurrence of a web breakage.

It is an object of the present invention to provide web-supply or reel store and web-supply apparatus which requires reduced operator intervention, possibly only a re-charging of a store with a supply of fresh reels once per shift or per day. It is a further object of the present invention to provide apparatus such that a continuous web can be fed effectively to a web-utilising machine from a position remote from the machine.

SUMMARY OF THE INVENTION

The present invention provides apparatus for supplying web material from reels thereof to a machine requiring a supply, particularly a substantially continuous supply, of web material, which apparatus comprises a reel changer including a reel store, means operable to advance reels in said store in succession or serially to a reel-unwinding location, a web-transport system operable to feed and guide to the machine, which may be disposed remotely from the reel changer, a web extending from a reel at said location, said transport system comprising at least one air mover, means to supply air under pressure to said air mover, means operable to sense the absence of web from a portion of the length of said transport system, and control means operable in response to signals from said sensing means to activate said air-supply means, whereby there is fed to the outlet end of said system a leading end of a web length extending continuously from a reel at said unwinding location. The transport system may provide a web path which includes curved portions, in which case the curved portions may be defined by air bearings. Advantageously, when the web is running continuously through the transport system, air is supplied to the air bearings, but not to the air mover or movers, whereas when a web end is being threaded via the transport system to the machine, air is supplied to the air mover or movers but not to the air bearings. Suitably, the sensing means is operable to detect the absence of web from an outlet end region of the transport system.

Web-supplying apparatus according to the present invention can be used with particular advantage in conjunction with web-end capture apparatus set forth and claimed in our co-pending United States Patent Application of even date and/or in conjunction with web-splicing apparatus set forth in a second co-pending United States Patent Application of even date for both of which applications we have claimed the same priority of date (Dec. 22, 1980, British Patent Application No. 81.41062) as has been claimed for the present application.

Thus, apparatus for capturing the outer end of a web to be unreeled may comprise rotatable reel-holding means which is drivable to rotate a reel in a reel-unwinding direction and in the contra direction, an elongate air mover so mounted that the inlet end thereof is movable nearer to and further from the axis of rotation of the reel-holding means so as to permit the maintenance of the said inlet end in close proximity to the periphery of a reel, held by said holding means, over a range of reel radii and means operable to sense the capture of a web-end at the said inlet end and thereupon to produce a capture signal in response to which the reel holding means is operable to change the direction of reel drive from the contra to the unwinding direction and permit travel of the web-end through the air mover.

The web-end capture apparatus may be used not only for the initial capture of a web-end prior to feeding the web to a utilising machine, but also in the event of web breakage at a location upstream of the inlet end of the air-mover of the capture apparatus. Advantageously the air mover is pivotably mounted at the outlet end thereof and rests at its inlet end in contact with the periphery of the reel, descending under gravity as the reel is unwound and thus accommodating its position to the decreasing radius of the reel. Preferably automatic lifting means is provided which is operable to raise the air mover clear of the path of a fresh reel during advancement thereof to the reel-holding means. Second sensing means may be provided to sense the arrival of the air mover at a position corresponding to a predetermined minimum radius of the reel and to provide a signal indicative of such arrival. This signal may be utilised to activate control means resulting in the replacement of the reel by a fresh reel and to initiate operation of a second apparatus operable to capture the outer end of a reeled web held by a second reel-holding means.

Advantageously, as set forth and claimed in our aforesaid second co-pending patent application of even date, the splicing apparatus referred to above comprises a web splicer, an air mover and means operable to present to the inlet end of the air mover the leading end of a first web extending from a first reel and the leading end of a second web extending from a second reel, said air mover being operable to feed the leading end of said first web from the end-presentation means to and through the splicing zone and being adapted to serve as a guide for continuous subsequent passage of the first web and thereafter to feed the leading end of the second web from the presentation means to the splicing zone during the continuous passage of said first web through the air mover.

There may be disposed at the downstream side of the splicing zone means operable, when the portion of the second web downstream of the splicing zone is severed from the remainder of the second web during the splicing operation, to withdraw that portion for disposal thereof. It is necessary that the web-splicing apparatus can operate in such fashion that the web extending from the second reel passes continuously through the air mover and the web extending from the first reel is the fresh web to be spliced to the continuously running web. Advantageously there is provided second withdrawal means disposed to that side of the path of the spliced web opposite that at which the first mentioned withdrawal means is disposed. Suitably the withdrawal means is, or are, an air mover or movers.

The leading end of the new web can initially be fed through the splicing zone and into a withdrawal means, but advantageously it can be fed to and maintained at the presentation means. The merit of this alternative arrangement is that should a breakage occur in the running web and should the reel from which that web extends have reached a predetermined minimum radius, then, after the portion of the web extending from that reel has been rewound so as to withdraw the end thereof from the air mover, the leading end of the new web can be fed through the air mover and forwardly therefrom to the web-utilising machine.

BRIEF DESCRIPTION OF THE DRAWINGS

In order that the present invention may be clearly understood and readily carried into effect, reference will now be made by way of example to the accompanying diagrammatic drawings, in which.

DETAILED DESCRIPTION OF THE PREFERRED EMBODIMENTS OF THE INVENTION

Figure 1:
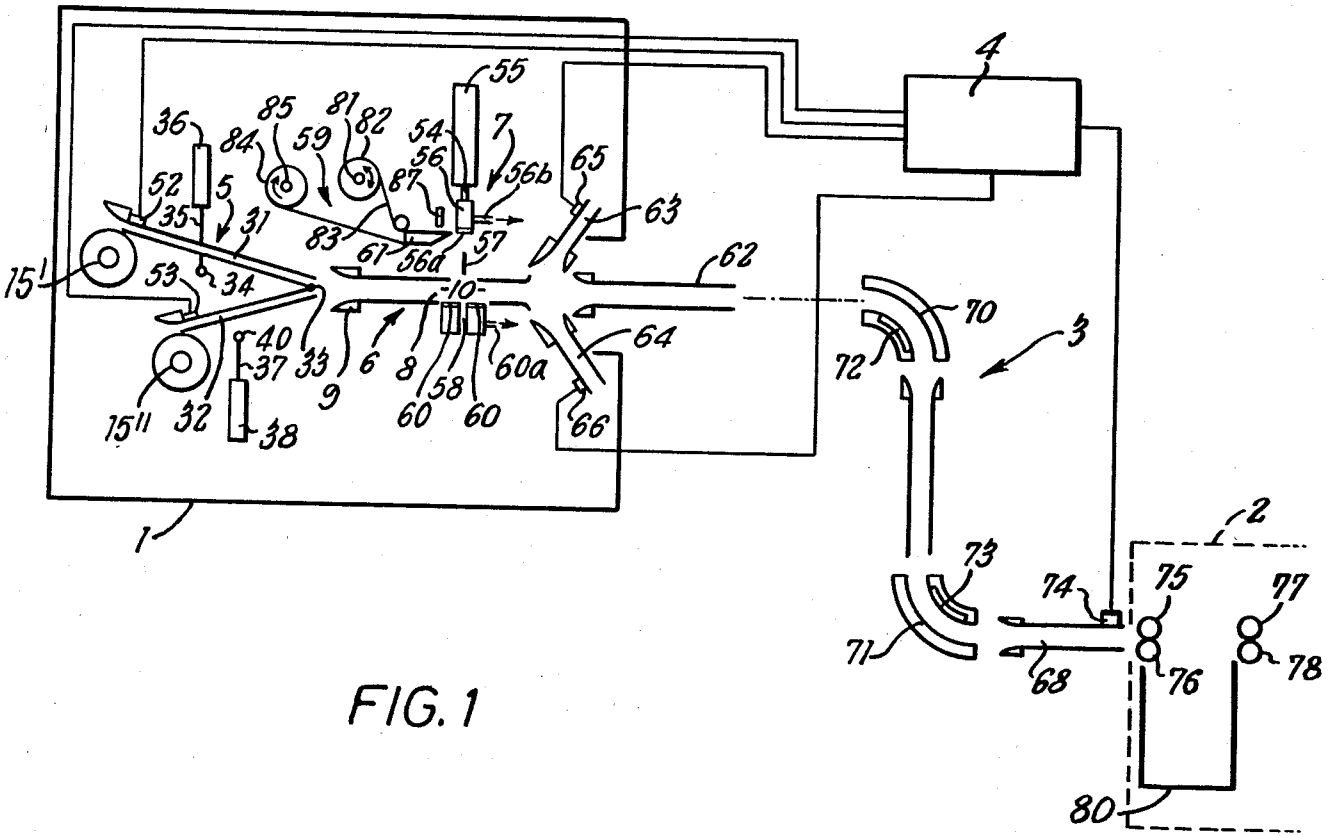
FIG. 1 shows an automatic apparatus for supplying web material to a web-utilising machine from a remote location.

The apparatus shown in FIG. 1 comprises a reel changer generally designated 1, a web-utilising machine 2, such as a cigarette maker or cigarette-filter maker, a pneumatic web-transport system generally designated 3 and electronic control means 4, which may be a microprocessor. The reel changer 1 includes a reel store 5 and a splicer unit 6 comprising a splicer 7 and an air mover 8 extending to each side of the splicing zone 10.

The reel store 5 comprises two reel storage and advancing units one mounted above the other. One such unit 11 illustrated in FIG. 2 comprises a hollow mandrel 12 mounted at one end thereof on fixed wall means 13 and extending horizontally therefrom. A shaft 14 extending axially through the mandrel 12 is mounted for rotational and axial movement relative thereto. Keyed to the shaft 14 at one end is a reel-holding drum 15. Respective drums 15', 15'' of the aforesaid two units 11 are shown in FIG. 1. Splined on the shaft 14 (FIG. 2) is a drive sleeve 16 of known design which accommodates the axial movement of the shaft. The shaft 14 is rotatable via the sleeve 16 by a reversible motor (not shown). Adjacent the sleeve 16, a grooved collar 17 is fixedly secured to the shaft 14. An arm 18 extending into the groove of the collar 17 is provided on the outer end of a piston rod 20 of a pneumatic piston and cylinder 21. Thus the shaft 14 can be moved to and fro axially in relation to the mandrel 12.

Figure 2:
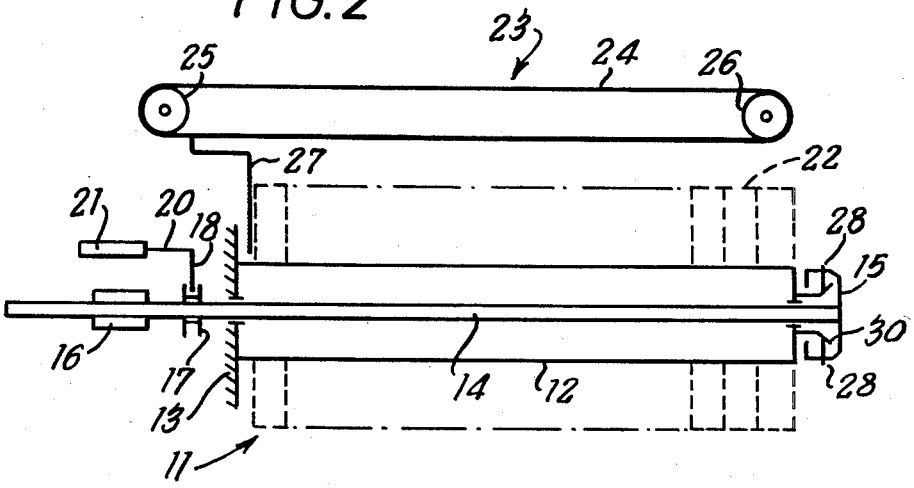
FIG. 2 is an elevation to a larger scale of a reel storage and advancing unit of the apparatus of FIG. 1.

On the mandrel 12 there may be supported a number of reels of web material, as indicated by broken line 22. The unit 11 further comprises reel-advancing means 23 in the form of an endless chain 24 running around sprockets 25, 26 one of which is drivable by a reversible motor (not shown). The chain 24 carries a cranked pusher arm 27. The drum 15 is provided with reel-engaging dogs 28 (only two of which are shown in FIG. 2), which extend through openings in the peripheral wall of the drum. The dogs are urged radially inwardly by resilient means (not shown) and their inner ends contact an inclined cam surface 30 fixed to the mandrel 12.

Assuming that, at the beginning of a proposed period of operation of the machine 2, a batch of reels 22, sufficient to meet the web requirement of that period has been placed upon the mandrel 12, the subsequent automatic operation of the unit 11 is as follows. By the action of the piston rod 20, the shaft 14 is moved axially to the left (in FIG. 2) until the drum 15 is almost in abutment with the end of the mandrel 12. The inner ends of the inwardly urged dogs 28 descend the cam surface 30 and thus their outer, reel engaging, ends are retracted to a position in which they no longer project from the peripheral surface of the drum 15. The drive motor is then activated to rotate the sprocket 25 in a counter-clockwise direction and move the pusher arm 27 towards the right. The batch of reels 22 is moved until the reel most remote from the arm 27 is fully located on the drum 15, at which time the aforesaid drive motor is stopped. Next the piston rod 20 is activated to move the shaft 14 and drum 15 towards the right until the drum has been returned to its initial, reel-unwinding, location. This movement separates the reel carried by the drum 15 from its neighbour in the batch carried on the mandrel 12 and also results in the dogs 28 being moved to and held in their reel-engaging positions. Thus, when the shaft 14 is subsequently rotated, in either direction, via the sleeve 16, the reel on the drum 15 is also rotated.

In FIG. 1, in addition to the reel-holding drums of the two storage and advancing units 11 of the reel store 5, designated 15' and 15'', the store 5 further comprises air movers 31, 32, associated with respective upper and lower units 11. The air movers 31, 32 are pivoted at their outlet ends at a common pivot point 33 and are arranged to rest at their inlet ends substantially tangentially at an upper part of the periphery of respective reels on the drums 15', 15''. By means of a lifting pin 34 carried at the lower end of a piston rod 35 extending from a cylinder 36, the air mover 31 can be pivoted upwardly to a position in which it is clear of the path of a fresh reel during advancement thereof to the drum 15'. Similarly, the air mover 32 can be pivoted to a reel-clearing position by a pin 40 carried by the upper end of a piston rod 37 extending from a cylinder 38.

Air movers are known devices for transporting webs. They are especially useful for transporting web material of a flimsy nature. An air mover illustrated diagrammatically in FIGS. 3 and 4 comprises an inlet block 41 through which extends an open-ended convergent/divergent passageway of rectangular cross-section defined by surfaces of upper and lower curved walls 42 (FIG. 3) and side walls 43 (FIG. 4). Also within the block are upper and lower plenum chambers 44, 45 to which air under pressure can be supplied, from a source not shown, through a pipe 46 communicating with a passage 47 in the block 41. Outlet slits 48, 50 extending across the full width of the surfaces 42 lead from the chambers 44, 45 to respective surfaces 42. Mounted in the block 41 is a length of ducting 51, of rectangular internal cross-section, which forms a continuation of the outlet end of the passageway defined by the walls 42, 43. In operation of the air mover, air issuing from the slits 48, 50 attaches itself to the curved walls 42. This results in the entrainment of ambient air and if the leading end of a web is presented to the passageway in the block 41 it will be caused to pass, with the air, through the passageway and the ducting 51.

Figure 3:
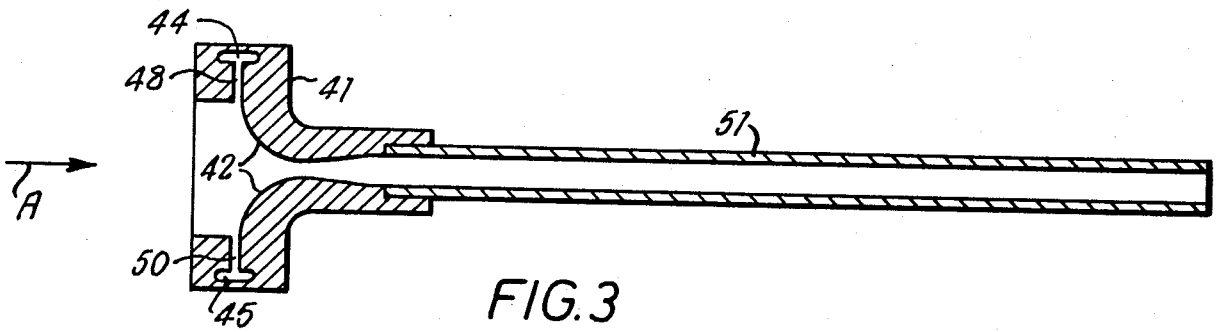
FIG. 3 is a sectional elevation of an air mover, again to a larger scale.
Figure 4:
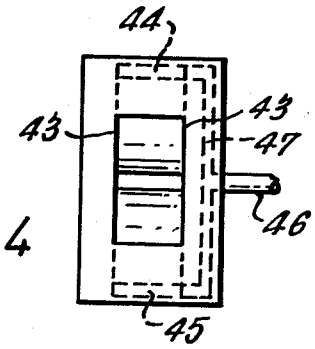
FIG. 4 is an end view of the air mover of FIG. 3 as seen in the direction of the arrow A.
Figure 5:
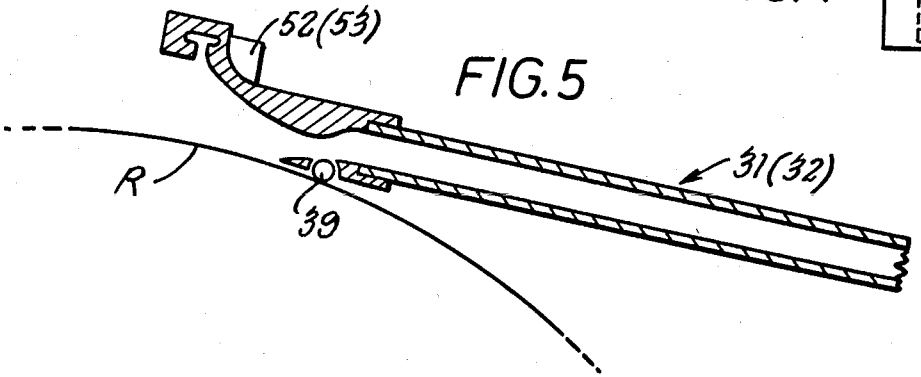
FIG. 5 is a view similar to FIG. 3 of an air mover having a modified form of inlet.

As illustrated in FIG. 5, the air movers 31, 32 of the reel store 5 have inlet ends formed with what is in effect only the upper half of the block 41 of the air mover shown in FIGS. 3 and 4. As will be seen from FIG. 5, the passageway of the modified inlet end is partly defined by the peripheral surface of the reel R. A freely rotating roller 39 which rests on the reel R is provided at the inlet end. This form of end serves to lift the web end from the periphery of the reel R when the latter is rotated in a direction contra to the unwinding direction, i.e. in a counter clockwise direction in FIGS. 1 and 5. The air movers 31, 32 are provided at their inlet ends with sensors 52, 53 operable to sense the capture of a web end.

Figure 6:
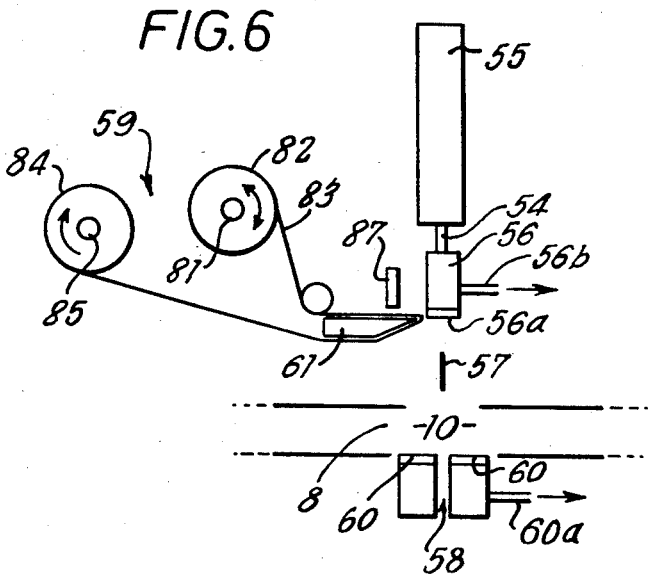
FIG. 6 is an elevational view to a larger scale of a splicer unit used with the apparatus of FIG. 1.

The splicer 7 of the splicer unit 6 comprises a piston rod 54 and cylinder 55. The lower end of the piston rod 54 carries a rectilinear block 56 to the resilient lower face **56*a* of which vacuum supplied at 56*b* can be applied. The splicer 7 also comprises a knife 57 with known knife-control cam mechanism which, for the sake of clarity, is not shown. The knife-control mechanism is so operatively connected to the rod 54 that downward movement of the latter causes the knife 57 to be moved downwardly through the splicing zone 10. After the knife has passed through the zone 10, the control mechanism causes the knife 57 to be swung to a position clear of that zone, for return upward movement, after completion of which the mechanism causes the knife to be swung back to its initial position. Fixedly mounted at a location below the block 56 is a block 58 having a narrow opening for the passage of the knife 57 and an upper resilient surface 60 at which vacuum supplied at 58*a* can be applied. Vacuum means (not shown) activatable upon receipt of command signals from the control means 4 is operable to apply controlled application of vacuum at the surface 56*a* and at the surface 60 by way of ports or openings (not shown) at the respective surfaces, as hereinafter described. The splicer 7 also comprises patch-supply means 59 (FIG. 6), operable to feed about a nose 61 a backing strip 83, carrying spaced-apart adhesive patches, so that patches are presented one at a time to the lower face 56*a* of the block 56 in its illustrated uppermost position level with the horizontal upper surface of the nose 61**.

Openings are provided in the air mover 8 of the unit 6 of sufficient width to permit movement therethrough of the block 56 and knife 57. The air mover has an inlet end block 9 of a form generally similar to that of the air mover described with reference to FIGS. 3 and 4. As may be seen from FIG. 1, the block 9 is located closely adjacent the outlet ends of the air movers 31, 32. Thus when a web is presented, by either of the air movers 31, 32, at the inlet end of the air mover 8, the web end is readily entrained by the air flow through the air mover 8. Consequently webs can be fed from either the upper or the lower storage unit 11 to or through the splicing zone 10. Near the outlet end of the air mover 8 there is disposed the inlet end of an air mover 62 which is axially aligned with the air mover 8 and forms an upstream part of the air-transport system 3. Above and below the inlet end of the air mover 62 are located the inlet ends of further air movers 63, 64 providing respective web-withdrawal means. The arrangement is such that the leading end of a web passing from the splicing zone 10 can be entrained by the air moving through the air mover 62 and thus be threaded into the web-transport system 3 for conveyance to the utilising machine 2. If, however, instead of being supplied to the inlet end of the air mover 62, compressed air is supplied to the inlet end of one of the air movers 63, 64, then the leading end of the web will enter that air mover and the web will be diverted from the normal feed path. Associated with the air movers 63, 64 are sensors 65, 66 operable to sense web presence in the respective said air movers.

The apex of the nose 61 of the patch-supply means 59 is disposed close to the lower face **56*a* of the block 56. From a reel 82 on a braked spool 81, the continuous backing strip 83 carrying the spaced-apart adhesive patches is trained about the nose 61 and extends therefrom to a reel 84 mounted on a take-up spool 85 rotatable in the direction indicated by the arrow by drive means (not shown). When a portion of the strip 83 carrying a patch is pulled around the apex of the nose 61, the backing strip becomes peeled away from the patch and the latter is received on the lower face of the block 56 and is held there by the vacuum applied. Upon completion of the transfer of a patch to the block 56, the supply of vacuum to the latter is discontinued in response to a signal from a sensor 87 operable to detect leading edges of patches on the strip 83**.

The web-transport system 3, only parts of which are shown in FIG. 1, comprises a plurality of air movers, some of which, 62, 67, 68, are shown. The web path defined by the system 3 may be 10 m or more in length and may include curves or bends, even right-angle bends. Curves or bends are defined by air bearing units, illustrated by units 70, 71, having plenum chambers 72, 73 to which compressed air can be supplied from a source (not shown) and from which ports open at the inner surfaces of the bends. As will be known to those skilled in the art, means whereby the web path can be turned in a plane other than that of the drawing of FIG. 1 may readily be provided.

Associated with the outlet end of the air mover 68 which defines the outlet end of the web path of the system 3, is a sensor 74 operable to sense the absence of a web at the said outlet end, which is positioned for feeding a web between a pair of co-operating, drivable feed rollers 75, 76 of the machine 2. From the rollers 75, 76, the web passes to a further pair of drivable rollers 77, 78 of the machine. The rollers 75, 76 may be driven at either substantially the same speed of rotation as the rollers 77, 78 or at a higher speed. In the latter case, as is well known in the cigarette and filter-making arts, a buffer-stock length of the web will be formed intermediate the rollers 75, 76 and the rollers 77, 78. A box 80 is provided to receive and contain the buffer stock.

The manner of operation of the web-supply system generally depicted in FIG. 1 will now be described.

It will be assumed that a condition obtains in which there is no web material in the utilising machine 2 or in either of the air movers 31, 32. Upon a manual initiation signal being given to the electronic control means 4, the latter initiates an operation of the upper reel storage and advancement unit 11 in order to bring a fresh reel into a reel unwinding location on the drum 15' of that unit, at which time the air mover 31 is held, by the lifting means 34, 35, 36, clear of the reel advancing to the drum. Under command of the control means 4, the drum 15' and the reel mounted thereon are caused to rotate slowly In the contra direction and the inlet end of the air mover 31 is lowered onto the periphery of the reel. When the leading end of the web is captured at the said inlet end, this condition is sensed by the sensor 52 (FIG. 5). Upon receiving a capture signal from the sensor 52, the control means 4 causes the drum 15' to cease rotation in the contra direction and to commence rotation in the unwinding direction, thus permitting the leading edge of the web to be fed through to the outlet end of the air mover 31. The control means 4 also causes conveying air to be supplied to the air-mover 8 and the air movers of the web-transport system 3. The web, upon issuing from the outlet end of the air mover 31, enters the air mover 8, passes through the splcing zone 10 to the outlet end of the air mover 8, enters the first air mover 62 of the system 3 and passes through the remaining length of that system to the machine 2. At the machine 2, the web is presented to the feed rollers 75, 76, this condition being signalled to the control means 4 by the sensor 74 or by a sensor (not shown) on the machine 2. By action of the control means 4, the drive to the drum 15' is terminated, the supply of conveying air to the air movers 31 and 8 and to those of the system 3 is discontinued and the air supply to air bearings 70, 71 is commenced. The air movers then act as web-guide means only, the web being drawn from the reel by the feed rollers 75, 76 of the machine 2.

The control means 4 will, when necessary, also initiate operation of the lower reel storage and advancing unit 11 to advance a fresh reel to the drum 15'' thereof, the air mover 32 being held in its reel-clearing position by the lifting unit 37, 38, 40. When the fresh reel has reached the reel-unwinding location on the drum 15'', the inlet end of the air mover 32 is lowered onto the periphery of the reel. The drum 15'' is caused to rotate slowly in the contra direction until capture of the web leading end is sensed by the sensor 33, whereupon the drum 15'' is caused to rotate in the unwinding direction until the leading end of the web has advanced to a location at or just upstream of the outlet end of the air mover 32. The leading end of the web is then brought to rest by discontinuance of the drive of the drum 15'' brought about in response to a timing signal developed within the control means 4 or in response to web-sensing means (not shown) located at the outlet end of the air mover 32. The lower, stationary, web is thus available for feeding forwardly to the machine 2 if the upper, running, web breaks at a location upstream of the sensor 74 and the upper reel has reached the predetermined minimum radius, which latter condition is determined by sensing means (not shown) connected to the control means 4. This sensing means may be so associated with the air mover 31 so to indicate the position thereof. Alternatively, as the reel from which the running web extends approaches exhaustion, a condition which may be indicated by the last mentioned or an additional sensing means connected to the control means 4, a signal from the control means 4 causes initiation of the supply of air to the air movers 31, 8 and 64 and another signal from the control means 4 initiates rotation, in the unwinding direction, of the drum 15'' of the lower unit 11. The end of the web extending from the reel on the drum 15'' is thus fed from the air mover 32 through the air mover 8 and into the air mover 64. The capture of the web by the air mover 64 is sensed by the sensor 66 which then sends a signal to the control means 4, uppon receipt of which the latter causes discontinuance of the air supply to the air mover 64 and also of the drive to drum 15''. The control means 4 then initiates and controls a splicing sequence as follows.

The rollers 75, 76 of the machine 2 are speeded up to cause a buffer stock of web to build up in box 80. During this build-up, an adhesive patch is fed by the patch-supply means 59 to the block 56 in its uppermost position as shown and is held on the lower face **56*a* of that block by the action of the vacuum therein. Also during the web build-up, vacuum application to the upper face 60 of the block 58 is commenced. At completion of the build-up the drive to the rollers 75, 76 is discontinued. The piston rod 54, then moves the block 56 downwardly. By action of the knife-control mechanism, the knife 57 descends and severs both the upper and lower webs extending through the splicing zone 10. Before the adhesive patch carried on the block face 56*a* enters the splicing zone, the drum 15' of the upper unit 11 is caused to rotate in the contra direction to withdraw that portion of the upper web which extends from the expired reel to the splicing zone. The adhesive patch is moved downwardly into the splicing zone and brought into contact with the trailing edge of the upper web and the leading edge of the fresh web. The splice thus formed is subjected to pressure as the lower resilient face 56*a* of the block 56 is pressed into contact with the resilient upper surface 60 of the block 58. The application of vacuum at the surfaces 56*a*, 60 is then discontinued, following which the air mover 64 is activated to withdraw the foremost portion of the lower web from the splicing zone 10. The drive to the feed rollers 75, 76 of the machine 2** is recommenced.

At the next splicing operation, there will be in the air mover 8 a stationary web length extending from a fresh reel held on the drum 15' of the upper unit 11 and, beneath that stationary length, a continuous length of web being unwound from a nearly expired reel held on the drum 15'' of the lower unit 11. The splicing sequence is as described above except that the upstream portion of the fresh web is removed by the air mover 63 after severance by the knife 57, but before application of an adhesive patch.

After a splicing operation has taken place, whether the fresh reel is on the drum 15' or the drum 15'', and after the portion of the web extending from the expired reel has been rewound onto the reel, in response to a signal from the control means 4 the expired reel will be pushed from the drum 15' or 15'' on which it is mounted by the advancement of the next fresh reel on to that drum.

Although the buffer stock has been described as being built up on the machine 2, means providing buffer stock may be disposed closely downstream of the splicer unit 6.

If a web running to the machine 2 breaks at a location intermediate the sensor 52 or 53 past which the web is running and the sensor 74, the portion of the web downstream of the breakage will be advanced out of the system 3 by the action of the driven rollers 77, 78 of the machine. The absence of web at the exit of the system 3 is then sensed by the sensor 74, which sends a web-absence signal to the control means 4. Upon receipt of this signal, the control means ascertains whether or not the running reel has been reduced to the predetermined minimum radius. If the minimum radius has not been reached the control means 4 causes the air supply to the air bearings 70, 71 to be discontinued, air supply to the air movers to be re-established, and the drum 15' or 15'' on which the reel in question is mounted to be rotated in the web-unwinding direction in order to re-thread the web into the machine 2. When this has been accomplished, the sensor 74 senses the presence of the web at the exit of the system 3. This results in discontinuance of the air supply to the air movers and re-establishment of the air supply to the air bearings 70, 71. If, however, the reel has reached the predetermined minimum radius when the breakage occurs, the drum is rotated in the contra direction to rewind onto the reel the portion of the web extending therefrom to the breakage location. Thereafter the other drum, on which the fresh reel is mounted, is rotated in the unwinding direction to permit the threading of a new web into the machine 2.

If the breakage in a running web occurs at the reel, this will be detected by the sensor 52 or 53 associated with the web. The control means 4 will in this case cause the reel to be rotated in the contra direction. If the web end is recaptured by the associated air mover 31 or 32, the reel will be rotated in the unwinding direction to permit re-threading of the web into the machine 2. If recapture does not occur within a predetermined period of time, a fresh web will be fed forwardly from the reel on the other drum and the first mentioned reel will be replaced by a fresh reel.

Web sensors additional to sensor 74 can with advantage be associated with the transport system 3. For example, a web sensor may be associated with each air mover in the system. Additional sensors make possible the attainment of a shorter time of response to web breakage or breakout in the system.

The reel storage and advancement means could take a form other than that of the units 11 described with reference to FIG. 2. The said means could be of a type in which reels are supported otherwise than by support means extending through openings in reel bobbins, so that fresh reels can be added to the depleted store at any time.

What is claimed is:

1. Apparatus for supplying web material from reels thereof to a web-utilising machine, comprising a reel changer including a reel store, means operable to advance reels in said store in succession to a reel-unwinding location, a web-transport system having an outlet end and means operable to feed and guide to the machine a web extending in a web path from a reel at the said unwinding location, which system comprises at least one air mover, means to supply air under pressure to the said air mover, means operable to sense the absence of web from a portion of the extent of the transport system and control means responsive to signals from said sensing means to activate air-supply to said air mover, wherein the web path of the transport system includes at least one curved portion defined by an air being and comprising means operative to supply air to the said air bearing when the web is running through the transport system but not to the air mover and when a web end is advanced to the air mover air is supplied to said air mover but not to said air bearing, whereby said leading end of a web length extending from a said reel can be fed to the outlet end of the said system.

2. Apparatus according to claim 1, wherein web-sensing means is provided at the entry end of an air mover extending from a reel-unwinding location.

3. Apparatus according to claim 1, wherein the entry end of an air mover extending from the reel-unwinding location is arranged to remain substantially tangential to the reel at that location despite change in the radius of the reel.

4. Apparatus according to claim 1, wherein the reel changer comprises a storage and advancing unit comprising a hollow mandrel, means for advancing reels along the mandrel to the unreeling location, and means operable at the unreeling location for coupling the reel to a rotatable shaft.

5. Apparatus according to claim 4, comprising two reel changers associated with respective air movers which can be selectively brought into operative relation with an onward-going further air mover.

6. Apparatus according to claim 5, comprising two reel changers associated with respective air movers which can be selectively brought into operative relation with an onward-going further air mover associated with web-severing and web-splicing means.

7. Apparatus according to claim 6, wherein the onward-going air mover is associated with further, selectively activatable, web-diversion and withdrawal air movers, and an air mover leading onwards towards the outlet of said transport system and towards said machine.

* * * * *